US006797318B2

(12) United States Patent
Takeuchi et al.

(10) Patent No.: US 6,797,318 B2
(45) Date of Patent: Sep. 28, 2004

(54) HEAT-SENSITIVE RECORDING MATERIAL AND HEAT-SENSITIVE RECORDING PROCESS

(75) Inventors: Koh Takeuchi, Shizuoka-ken (JP); Toshio Hara, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 13 days.

(21) Appl. No.: 09/942,029

(22) Filed: Aug. 30, 2001

(65) Prior Publication Data

US 2002/0061820 A1 May 23, 2002

(30) Foreign Application Priority Data

| | | |
|---|---|---|
| Aug. 30, 2000 | (JP) | 2000-261933 |
| Aug. 30, 2000 | (JP) | 2000-261934 |
| Jul. 25, 2001 | (JP) | 2001-224555 |

(51) Int. Cl.[7] ..... B41M 5/40
(52) U.S. Cl. ..... 427/152; 503/200; 503/226
(58) Field of Search ..... 427/152; 503/200, 503/226

(56) References Cited

U.S. PATENT DOCUMENTS

| | | | | |
|---|---|---|---|---|
| 5,866,507 A | * | 2/1999 | Suzaki et al. | 503/207 |
| 5,952,263 A | * | 9/1999 | Suzaki et al. | 503/200 |

FOREIGN PATENT DOCUMENTS

| | | |
|---|---|---|
| JP | 3201879 | 6/2001 |
| JP | 2001-162934 B1 | 6/2001 |
| JP | 2001-199165 B1 | 7/2001 |

* cited by examiner

*Primary Examiner*—Bruce H. Hess
(74) *Attorney, Agent, or Firm*—Sughrue Mion, PLLC

(57) ABSTRACT

A heat-sensitive recording material and a recording process. The heat-sensitive recording material is excellent in head-matching property and has a good coating surface without coating failure. The heat-sensitive recording material has, on a support, a heat-sensitive recording layer, a protective layer and other layers as necessary. The protective layer contains a specific aliphatic compound derivative having at least a —CONH— structure and/or a water-soluble polymer having a specific repeating unit.

9 Claims, 1 Drawing Sheet

HEAT-SENSITIVE RECORDING MATERIAL AND HEAT-SENSITIVE RECORDING PROCESS

BACKGROUND OF THE INVENTION

1. Field of the Invention

The present invention relates to a heat-sensitive recording material and a heat-sensitive recording process, and more particularly, to a heat-sensitive recording material and a heat-sensitive recording process of high image quality that is suitable for a medical-use recording medium.

2. Description of the Related Art

A heat-sensitive recording process has such advantages that (1) development is not necessary, (2) in the case where a support is paper, the material is similar to ordinary paper, (3) easy handling, (4) the coloring density is high, (5) a recording apparatus is convenient and has high reliability at low cost, (6) no noise during recording, and (7) no maintenance. Therefore, it has developed in various fields in recent years, and has spread, for example, in the field of facsimile machines and printers and the field of labels, such as POS systems.

As heat-sensitive recording materials used in the heat-sensitive recording process, materials utilizing a reaction between an electron donative colorless dye and an electron acceptive compound and materials utilizing a reaction between a diazo compound and a coupler have been known.

Against this background, projection of images and the like with overhead projectors, direct observation of images and the like on light tables, and the like are in demand. In order to meet this demand, and in response to the spread of multi-color systems in recent years, the development of transparent heat-sensitive recording materials that can be directly recorded by thermal heads is desired.

Accordingly, a heat-sensitive recording material has been proposed that is produced in such a manner that a substantially colorless coloring component A and a substantially colorless coloring component B that colors through a reaction with the coloring component A are dispersed in a binder in fine particle form or, in alternative, one of the components A and B is formed into microcapsules, and the other is formed into an emulsion, so as to form a heat-sensitive recording layer which is provided on a transparent support, such as a synthetic polymer film.

In this transparent heat-sensitive recording material, although the transparency of the material itself is good, it has problems in that sticking and noise are liable to occur when printing in a heat-sensitive recording apparatus, such as a heat-sensitive printer. Particularly, in cases where the transparent heat-sensitive recording material is used for medical applications, the heat energy applied by a thermal heat is large, due to a high transmission density demanded, and thus problems of sticking, noise on printing and wearing of a thermal head become serious. In order to prevent sticking and noise, there have been attempts to provide a protective layer containing a pigment and a binder as main components on the heat-sensitive recording layer, and to further add various lubricating agents in the protective layer. However, this is not preferred in medical applications since the lubricating agent attaches to the head as contamination and causes unevenness in image density.

Because high energy recording with a high black ratio is conducted in images of medical applications, the thermal head is worn, which changes a thermal conduction property from a head-heating element, whereby unevenness in density occurs. It has been proposed to provide a layer containing chemically stable carbon having a high hardness as a main component on the surface of the head to prevent wearing of the thermal head. However, the carbon layer has such characteristics that a surface energy is lower than the surface layer of a conventional thermal head (such as SiN and SiC), which increases a friction coefficient with the protective layer of the heat-sensitive recording material, and increases the problems of sticking and noise.

SUMMARY OF THE INVENTION

An object of the present invention is to solve the problems associated with the conventional art, and thus to provide a heat-sensitive recording material that is excellent in a head-matching property.

Another object of the present invention is to provide a heat-sensitive recording material of high image quality in which energy dependency of a friction coefficient between a head and the heat-sensitive recording material is suppressed and a density step caused by the printing energy is decreased.

The present invention relates to, in one aspect, a heat-sensitive recording material having: (a) a support; and (b) a plurality of layers formed on the support, including at least a heat-sensitive recording layer and a protective layer formed on the heat-sensitive recording layer, the protective layer including at least one compound represented by one of the following structural formulae (1), (2) and (3) or a water-soluble polymer having a repeating unit represented by the following structural formula (4):

Structural formula (1)

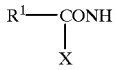

Structural formula (2)

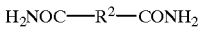

Structural formula (3)

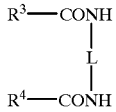

Structural formula (4)

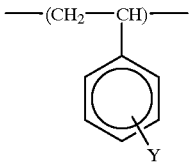

in which, in the structural formulae (1), (2) and (3), X represents H or $CH_2OH$; $R^1$, $R^2$, $R^3$ and $R^4$ each represents a saturated or unsaturated alkyl group having from 8 to 24 carbon atoms, which alkyl group is optionally branched and optionally has a hydroxyl group; $R^3$ and $R^4$ may be the same and may be different; and L represents the following structural formula (5):

Structural formula (5)

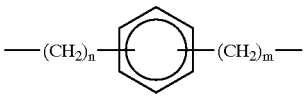

in which n+m is an integer from 0 to 8, and, in the structural formula (4), Y represents H, —$SO_3A$ or —COOA, and A represents Na, K, $NH_4$ or $NH(C_2H_4OH)_3$.

Preferably, in the heat-sensitive recording material, the at least one compound represented by one of the structural formulae (1), (2) and (3) is contained in the protective layer in an amount of from 0.5 to 10% by weight based on total dry coating amount of the protective layer.

In another aspect of the present invention, in the heat-sensitive recording material, the at least one compound represented by one of the structural formulae (1), (2) and (3) is selected from the group consisting of stearic amide, ethylene bisstearoamide, methylol stearoamide, lauric amide, ethylene bislaurilamide, myristic amide, palmitic amide and behenic amide.

Preferably, in the heat-sensitive recording material, the protective layer contains stearic amide in an amount of from 0.5 to 10% by weight based on total dry coating amount of the protective layer.

In a further aspect of the present invention, in the heat-sensitive recording material, the support and the heat-sensitive recording layer are substantially transparent.

In yet another aspect of the present invention, a thermal head is placed in contact with the heat-sensitive recording material during image recording, and a difference in transportation torque when applying a minimum amount of heat for causing coloring in the heat-sensitive recording material and when applying an amount of heat for causing a color transmission density of approximately 3.0 is no more than 2 Kg·cm.

In a yet further aspect of the present invention, in the heat-sensitive recording material, the protective layer includes the water-soluble polymer having a repeating unit represented by the structural formula (4).

In still another aspect of the present invention, in the heat-sensitive recording material as claimed in claim 7, the water-soluble polymer includes at least a water-soluble polymer represented by one of the following structural formulae (6), (7), (8) and (9):

Structural formula (6)

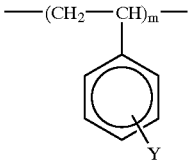

Structural formula (7)

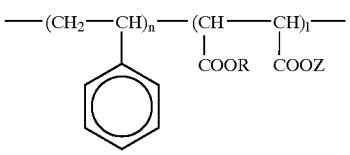

-continued

Structural formula (8)

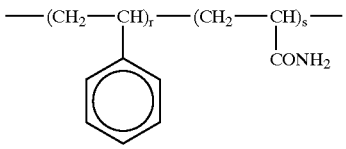

Structural formula (9)

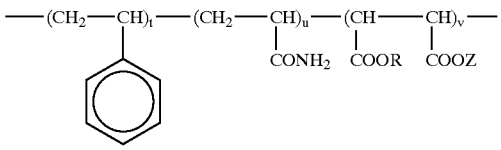

in which Y represents —$SO_3A$ or —COOA, and A represents Na, K, $NH_4$ or $NH(C_2H_4OH)_3$; m represents an integer of at least 10; n represents a number from 0.1 to 0.9, l represents a number from 0.9 to 0.1, and n+l is 1.0; r represents a number from 0.1 to 0.9, s represents a number from 0.9 to 0.1, and r+s is 1.0; t represents a number from 0.1 to 0.9, u represents a number from 0.1 to 0.9, v represents a number from 0.1 to 0.9, and t+u+v is 1.0; R represents an alkyl group having 2 or more carbon atoms; and Z represents Na, K, $NH_4$ or $NH(C_2H_4OH)_3$.

Preferably, the protective layer contains the water-soluble polymer in an amount of from 1 to 10% by weight based on total dry coating amount of the protective layer.

A still further aspect of the present invention is a heat-sensitive recording process featuring the steps of: (a) preparing the heat-sensitive recording material; and (b) subjecting the heat-sensitive recording material to heat using a thermal head which has an uppermost layer having a carbon content of at least 90%.

DETAILED DESCRIPTION OF THE PREFERRED EMBODIMENTS

Figure 1:
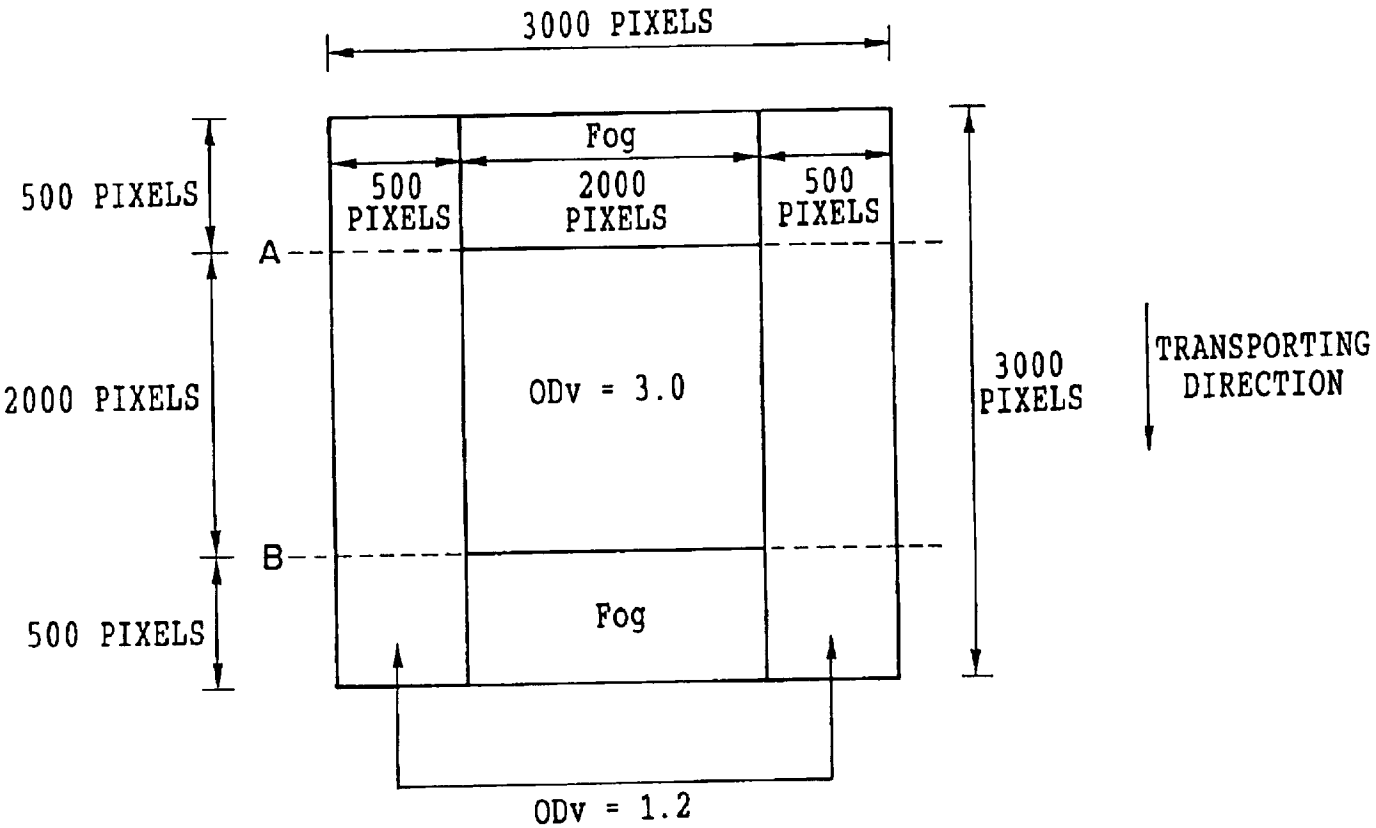
FIG. 1 is an explanatory diagram showing a measurement method of a density step.

The heat-sensitive recording material of the present invention will be described in detail below.

The heat-sensitive recording material of the present invention comprises a support having thereon a heat-sensitive recording layer and a protective layer in this order, and further comprising an additional layer depending on necessity.

Protective Layer

The protective layer is formed on the heat-sensitive recording layer or, in alternative, in a case where an intermediate layer is formed as an additional layer on the heat-sensitive recording layer, the protective layer is formed on the intermediate layer.

The protective layer is formed by coating a protective layer coating composition, and the protective layer coating composition contains (i) an aliphatic compound derivative having at least a —CONH— structure (hereinafter sometimes referred to as an amide compound) or (ii) a water-soluble polymer having a repeating unit represented by the following structural formula (4) in order to improve a head-matching property, and further contains additional components depending on necessity.

(i) Amide Compound

The amide compound is represented by one of the following structural formulae (1) to (3):

Structural formula (1)

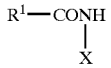

Structural formula (2)

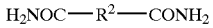

Structural formula (3)

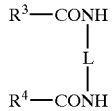

In the structural formulae (1), (2) and (3), X represents H or $CH_2OH$; $R^1$, $R^2$, $R^3$ and $R^4$ each represents a saturated or unsaturated alkyl group having from 8 to 24 carbon atoms, which is optionally branched and optionally has a hydroxyl group, with $R^3$ and $R^4$ being the same or different; and L represents the following structural formula (5):

Structural formula (5)

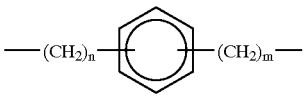

In the structural formula (5), n+m is a number from 0 to 8.

Among these, compounds represented by the structural formulae (1) and (3) are preferred, and $R^1$, $R^3$ and $R^4$ each is preferably a saturated or unsaturated alkyl group having from 12 to 20 carbon atoms. The alkyl group may be branched and may have h of hydroxyl group(s) in the structure thereof. n+m is from 0 to 4, is preferably 2 in the case h=0, and is preferably 0 to 2 in the case h=1.

The amide compound, in the case where it is solid, is used (1) in the form of a water dispersion formed by dispersing by using a known dispersing apparatus, such as a homogenizer, a dissolver or a sand mill, in the presence of a dispersing agent, such as a water-soluble polymer, e.g., polyvinyl alcohol, and various kinds of surface-active agent, or (2) in the form of an emulsion formed by dissolving in a solvent and then emulsifying by using a known emulsifying apparatus, such as a homogenizer, a dissolver or a colloid mill, in the presence of a dispersing agent, such as a water-soluble polymer, e.g., polyvinyl alcohol, and various kinds of surface-active agent.

In the case where the amide compound is in a liquid state, the average particle diameter of the dispersion and the emulsion used in the form of the emulsion is preferably from 0.1 to 5.0 $\mu$m, and more preferably from 0.1 to 2 $\mu$m. The average particle diameter herein means a 50% average particle diameter measured by using a laser diffraction particle size distribution measuring apparatus, LA700 produced by Horiba, Ltd., at a transmission rate of 75±1%.

The amount ratio of the amide compound in the total dry coating amount of the protective layer is preferably in the range of from 0.5 to 10% by weight, and when it in this range, a sufficient head-matching property is obtained, and problems of contamination of the head and sticking on the surface do not occur. The more preferred range thereof is from 1 to 5% by weight.

(ii) Water-Soluble Polymer Having Repeating Unit Represented by Structural Formula (4)

Structural formula (4)

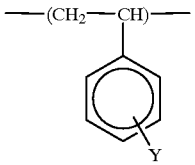

In the structural formula (4), Y represents H, $—SO_3A$ or —COOA, wherein A represents Na, K, $NH_4$ or $NH(C_2H_4OH)_3$.

Examples of the water-soluble polymer include polymer compounds represented by the following structural formulae (6) to (9).

Structural formula (6)

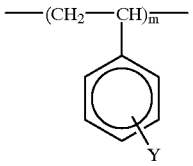

Structural formula (7)

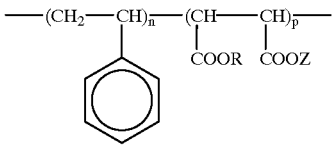

Structural formula (8)

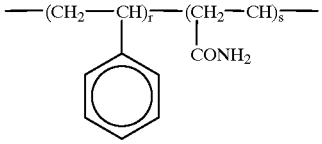

Structural formula (9)

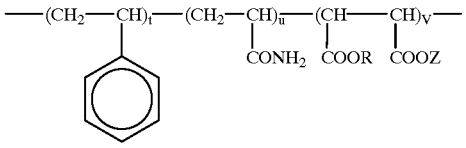

In the structural formulae (6) to (9), Y represents $—SO_3A$ or —COOA, wherein A represents Na, K, $NH_4$ or $NH(C_2H_4OH)_3$, m represents an integer of 10 or more, n represents a number from 0.1 to 0.9, l represents a number from 0.9 to 0.1, provided that n+l is 1.0, r represents a number from 0.1 to 0.9, s represents a number from 0.9 to 0.1, provided that r+s is 1.0, t represents a number from 0.1 to 0.9, u represents a number from 0.1 to 0.9, v represents a number from 0.1 to 0.9, provided that t+u+v is 1.0, R represents an alkyl group having 2 or more carbon atoms, and Z represents Na, K, $NH_4$ or $NH(C_2H_4OH)_3$.

Preferred examples of the polymer compound represented by the structural formulae (6) to (9) include styrene sulfonate, a styrene-maleic acid copolymer or a salt thereof, a styrene-acrylamide copolymer and a styrene-maleic acid-acrylamide copolymer or a salt thereof. In the case where coating of the polymer compound is conducted by using an aqueous system, the polymer compound preferably has a water solubility of 5% or more, and more preferably 15% or more.

In the case of a styrene-maleic acid copolymer, a styrene-acrylamide copolymer or a styrene-maleic acid-acrylamide copolymer, the content of the styrene structure is preferably from 10 to 90% by mole. When the content of the styrene structure is in the range of from 10 to 90% by mole, it is suitable for coating by an aqueous system since the energy dependency of the friction coefficient becomes small, and the water solubility of the polymer compound can be maintained. In the case of a styrene sulfonate, the average molecular weight is preferably 2,000 or more, and more preferably 5,000 or more. In the case where the average molecular weight is 5,000 or more, the head is less likely to become contaminated and cause image obstruction.

Examples of a cation species forming the salt include an alkali metal, ammonium and triethanolamine. In particular, an ammonium salt and a trietanolamine salt are preferred from the standpoint that chemical corrosion of the thermal head can be prevented.

The amount ratio of the water-soluble polymer represented by the structural formula (4) in the total dry coating amount of the protective layer is preferably from 1 to 10% by weight, and more preferably from 2 to 8% by weight. When the amount is in this range, formation of density unevenness can be suppressed, and the stability of the coating composition is increased.

In addition to the amide compound and the water-soluble polymer represented by the structural formula (4), the protective layer of the heat-sensitive recording material of the present invention may contain a known lubricating agent (such as paraffin wax, a higher fatty acid, a higher fatty acid salt, a higher fatty acid amide, a silicone compound or a fluorine-containing compound).

The protective layer of the heat-sensitive recording material of the present invention may further contain a pigment. The pigment generally makes the thermal head more suitable for recording. That is, the pigment is used to suppress sticking and occurrence of abnormal noise, and it is preferred to use an organic and/or inorganic pigment.

The pigment that can be used in the protective layer preferably has an average particle diameter, specifically a 50% volume average particle diameter measured by a laser diffraction method, of from 0.10 to 5.00 $\mu$m, and more preferably a 50% volume average particle diameter of from 0.20 to 0.50 $\mu$m particularly from the standpoint that sticking and abnormal noise formed between the thermal head and the heat-sensitive recording material upon recording by using the head. The 50% volume average particle diameter measured by a laser diffraction method referred to herein is an average particle diameter of the pigment particles corresponding to a 50% volume of the pigment, and is measured by using a laser diffraction particle size distribution measuring apparatus, LA700 produced by Horiba, Ltd., and is sometimes simply referred to as "average particle diameter".

When the 50% volume average particle diameter is in the range of from 0.10 to 5.00 $\mu$m, an effect of lowering wear of the thermal head is large, and an effect of prevention of adhesion between the thermal head and a binder contained in the protective layer is large, whereby the so-called sticking, in which the thermal head and the protective layer of the heat-sensitive recording material are adhered upon printing, can be effectively prevented.

The pigment contained in the protective layer is not particularly limited, and known organic and inorganic pigments can be used. Among these, an inorganic pigment, such as calcium carbonate, titanium oxide, kaolin, aluminum hydroxide, amorphous silica or zinc oxide, and an organic pigment, such as a urea formalin resin or an epoxy resin, are preferred. Among these, kaolin, aluminum hydroxide and amorphous silica are more preferred. These pigments may be used singly or used in a combination of two or more kinds thereof.

The pigment may be subjected to surface coating with at least one of a higher fatty acid, a metallic salt of a higher fatty acid and a higher alcohol.

Examples of the higher fatty acid include stearic acid, palmitic acid, myristic acid and lauric acid.

It is preferred that the pigment is used after dispersing to the foregoing average particle diameter by using a known dispersing apparatus, such as a dissolver, a sand mill or a ball mill, in the presence of a dispersion assistant, such as sodium hexametaphosphoric acid, partially saponified or completely saponified modified polyvinyl alcohol, a polyacrylic acid copolymer and various surface-active agents, preferably in the presence of partially saponified or completely saponified modified polyvinyl alcohol or an ammonium salt of a polyacrylic acid copolymer. In other words, it is preferred that the pigment is used after dispersing to have a 50% volume average particle diameter in the range of from 0.10 to 5.00 $\mu$m.

Binder

Preferred examples of the binder include polyvinyl alcohol, carboxyl-modified polyvinyl alcohol and silica-modified polyvinyl alcohol, from the standpoint that the transparency of the protective layer will be excellent.

Other Components

The protective layer may contain a known hardening agent.

In order to uniformly form the protective layer on the heat-sensitive recording layer or the intermediate layer, it is preferred to add a surface-active agent to the protective layer coating composition. Examples of the surface-active agent include a sulfosuccinic acid series alkali metal salt and a fluorine-containing surface-active agent, and specific examples thereof include a sodium salt or an ammonium salt of di(2-ethylhexyl)sulfosuccinic acid and di(n-hexyl) sulfosuccinic acid.

Furthermore, the protective layer may contain a surface-active agent, metallic oxide fine particles, an inorganic electrolyte and a polymer electrolyte in order to prevent static charging of the heat-sensitive recording material.

The protective layer may have a single layer structure or an accumulated layer structure containing two or more layers. The dry coating amount of the protective layer is preferably from 0.2 to 7 g/m$^2$, and more preferably from 1 to 4 g/m$^2$.

Heat-Sensitive Recording Layer

The heat-sensitive recording layer contains at least a coloring component, and also contains other components depending on necessity.

Coloring Component

As the heat-sensitive recording layer, any composition can be used as long as it has excellent transparency before treating and exhibits a color after heating.

Examples of the heat-sensitive layer include a so-called two-component heat-sensitive layer containing a substantially colorless coloring component A and a substantially colorless coloring component B that colors through a reaction with the coloring component A. It is preferred that the coloring component A and the coloring component B each is incorporated in microcapsules. Examples of the combination of two components constituting the two-component heat-sensitive layer include the following (a) to (m):

(a) A combination of an electron donative dye precursor and an electron acceptive compound;

(b) A combination of a photolytic diazo compound and a coupler;

(c) A combination of an organic metallic salt, such as silver behenate or silver stearate, and a reducing agent, such as protocatechinic acid, spiroindane or hydroquinone;

(d) A combination of a long chain aliphatic salt, such as ferric stearate or ferric myristate, and a phenol compound, such as gallic acid or ammonium salicylate;

(e) A combination of a heavy metallic salt of an organic acid, such as a salt of acetic acid, stearic acid or palmitic acid and nickel, cobalt, lead, copper, iron, mercury or silver, with a sulfide of an alkaline earth metal, such as calcium sulfide, strontium sulfide or potassium sulfide; or a combination of a heavy metallic salt of an organic acid and an organic chelate agent, such as s-diphenylcarbazide or diphenylcarbazone;

(f) A combination of a (heavy) metallic sulfate, such as silver sulfide, lead sulfide, mercury sulfide and sodium sulfide, and an sulfur compound, such as sodium tetrathionate, sodium thiosulfate and thiourea;

(g) A combination of an aliphatic ferric salt, such as ferric stearate, and an aromatic polyhydroxy compound, such as 3,4-dihydroxytetraphenylmethane;

(h) A combination of an organic noble metallic salt, such as silver oxalate or mercury oxalate, and an organic polyhydroxy compound, such as polyhydroxy alcohol, glycerin or glycol;

(i) A combination of an aliphatic ferric salt, such as ferric pelargonate or ferric laurate, and a thiocesylcarbamide or isothiocesylcarbamide derivative;

(j) A combination of an organic acid lead salt, such as lead caproate, lead pelargonate or lead behenate, and a thiourea derivative, such as ethylene thiourea or N-dodecyl thiourea;

(k) A combination of a higher fatty acid heavy metallic salt, such as ferric stearate or copper stearate, and zinc dialkyldithocarbamate;

(l) A combination forming an oxazine dye, such as a combination of resorcin and a nitroso compound; and (m) A combination of formazan compound and a reducing agent and/or a metallic salt.

Among these, the combination of an electron donative dye precursor and an electron acceptive compound (a), the combination of a photolytic diazo compound and a coupler (b), and the combination of an organic metallic salt and a reducing agent (c) are preferably used in the heat-sensitive recording material of the present invention, and the combinations (a) and (b) are more preferred.

In the heat-sensitive recording material of the present invention, an image excellent in transparency can be obtained by configuring the heat-sensitive recording layer to have a decreased haze value, as calculated from the equation: (diffusion transmittance/total light transmittance)×100 (%). The haze value is an index expressing the transparency of a material, and in general, is calculated from a total light transmitting amount, a diffusion transmitted light amount and a parallel transmitted light amount by using a haze meter.

Examples of the method for decreasing the haze value in the present invention include a method in which the 50% volume average particle diameters of the coloring components A and B each is 1.0 μm or less, preferably 0.6 μm or less, and the binder is contained in the heat-sensitive recording layer in an amount in the range of from 30 to 60% by weight based on total solid content, and a method in which the coloring components A and B are used as a composition like an emulsion, for example, one of the coloring components A and B is formed into microcapsules, and the other forms a substantially continuous phase after coating and drying.

Such a method is also effective in that the refractive indexes of the components used in the heat-sensitive recording layer are made to approach as near a certain value as possible.

The combinations (a), (b) and (c), which are preferably used in the heat-sensitive recording layer, will be described in detail below.

The combination of an electron donative dye precursor and an electron acceptive compound (a) will be described below.

An electron donative dye precursor that can be preferably used in the present invention is not particularly limited as long as it is substantially colorless, and is preferably a colorless compound that has such a nature that it colors by donating an electron or by accepting a proton, such as an acid, and in particular, it has a partial skeleton, such as a lactone, a lactam, a saltone, a spiropyran, an ester or an amide, which is subjected to ring opening or cleavage in the case where it is in contact with the electron acceptive compound.

Examples of the electron donating dye precursor include a triphenylmethane phthalide series compound, a fluorane series compound, a phenothiazine series compound, an indolyl phthalide series compound, a leucoauramine series compound, a rhodamine lactam series compound, a triphenylmethane series compound, a triazene series compound, a spiropyran series compound, a fluorene series compound, a pyridine series compound and a pyradine series compound.

Specific examples of the phthalide series compound include the compounds described in U.S. Pat. No. Re. 23,024, U.S. Pat. No. 3,491,111, U.S. Pat. No. 3,491,112, U.S. Pat. No. 3,491,116, and U.S. Pat. No. 3,509,174.

Specific examples of the fluorane series compound include the compounds described in U.S. Pat. No. 3,624,107, U.S. Pat. No. 3,627,787, U.S. Pat. No. 3,641,011, U.S. Pat. No. 3,462,828, U.S. Pat. No. 3,681,390, U.S. Pat. No. 3,920,510 and U.S. Pat. No. 3,959,571.

Specific examples of the spiropyran series compound include the compounds described in U.S. Pat. No. 3,971,808.

Specific examples of the pyridine series and pyradine series compounds include the compounds described in U.S. Pat. No. 3,775,424, U.S. Pat. No. 3,853,869 and U.S. Pat. No. 4,246,318.

Specific examples of the fluorene series compound include the compounds described in Japanese Patent Application No. 61-240989.

Among these, a 2-arylamino-3-(H, halogen, alkyl or alkoxy-6-substituted aminofluorane) is preferably exemplified.

Specific examples thereof include 2-anilino-3-methyl-6-diethylaminofluorane, 2-anilino-3-methyl-6-N-cyclohexyl-N-methylalfluorane, 2-p-chloroanilino-3-methyl-6-dibutylaminofluorane, 2-anilino-3-methyl-6-dioctylaminofluorane, 2-anilino-3-chloro-6-diethylaminofluorane, 2-anilino-3-methyl-6-N-ethyl-N-isoamylaminofluorane, 2-anilino-3-methyl-6-N-ethyl-N-dodecylaminofluorane, 2-anilino-3-methoxy-6-dibutylaminofluorane, 2-o-chloroanilino-6-dibutylaminofluorane, 2-p-chloroanilino-3-ethyl-6-N-ethyl-N-isoamylaminofluorane, 2-o-chloroanilino-6-p-butylanilinofluorane, 2-anilino-3-pentadecyl-6-diethylaminofluorane, 2-anilino-3-ethyl-6-dibutylaminofluorane, 2-o-toluidino-3-methyl-6-diisopropylaminofluorane, 2[]anilino-3-methyl-6-N-isobutyl-N-ethylaminofluorane, 2-anilino-3-methyl-6-N-ethyl-N-tetrahydrofurfurylaminofluorane, 2-anilino-3-chloro-6-N-ethyl-N[]isoamylaminofluorane, 2-anilino-3-methyl-6-N-methyl-N-γethoxypropylaminofluorane, 2-anilino-3-methyl-6-N-ethyl-N-γ-ethoxypropylaminofluorane and 2-anilino-3-methyl-6-N-ethyl-N-γ-propoxypropylaminofluorane.

Examples of the electron acceptive compound, which reacts with the electron donative dye precursor, include an acidic substance, such as a phenol compound, an organic acid or a metallic salt thereof, and an oxybenzoate, and specific examples thereof include the compounds described in JP-A-61-291183.

Specific examples thereof include:

a bisphenol compound, such as 2,2-bis(4'-hydroxyphenyl) propane (generic name: bisphenol A), 2,2-bis(4-hydroxyphenyl)pentane, 2,2-bis(4'-hydroxy-3',5'-dichlorophenyl)propane, 1,1-bis(4'-hydroxyphenyl) cyclohexane, 2,2-bis(4'-hydroxyphenyl) hexane, 1,1-bis(4'-hydroxyphenyl)propane, 1,1-bis(4'-hydroxyphenyl)butane, 1,1-bis(4'-hydroxyphenyl) pentane, 1,1-bis(4'-hydroxyphenyl)hexane, 1,1-bis (4'-hydroxyphenyl)heptane, 1,1-bis(4'-hydroxyphenyl) octane, 1,1-bis(4'-hydroxyphenyl)-2-methylpentane, 1,1-bis(4'-hydroxypenyl)-2-ethylhexane, 1,1-bis(4'-hydroxyphenyl)dodecane, 1,4-bis(p-hydroxyphenylcumyl)benzene, 1,3-bis(p-hydroxyphenylcymy1)benzene, bis(p-hydroxyphenyl) sulfone, bis(3-allyl-4-hydroxyphenyl)sulfone and bis (p-hydroxyphenyl)acetic acid benzyl ester; a salicylic acid derivative, such as 3,5-di-α-methylbenzylsalicylic acid, 3,5-di-tert-butylsalicylic acid, 3-α-α-dimethylbenzylsalicylic acid and 4-(β-p-methoxyphenoxyethoxy)salicylic acid; a polyvalent metallic salt thereof (in particular, a zinc salt and an aluminum salt are preferred); an oxybenzoate, such as p-hydroxybenzoic acid benzyl ester, p-hydroxybenzoic acid 2-ethylhexyl ester and β-resorcinic acid 2-phenxyethyl ester; and a phenol compound, such as p-phenylphenol, 3,5-diphenylphenol, cumylphenol, 4-hydroxy-4'-phenoxydiphenylsulfone.

Among these, a bisphenol compound is preferred from the standpoint of obtaining good coloring characteristics.

The electron acceptive compounds may be used singly or in a combination of two or more.

The combination of a photolytic diazo compound and a coupler will be described below.

The photolytic diazo compound is a compound that colors to exhibit a desired color tone through a coupling reaction with the coupler, which is a coupling component described later, and is decomposed if it receives light of a particular wavelength range before the reaction, to lose coloring ability even though the coupling component is present.

The color tone in this coloring system is determined by a diazo dye formed through the reaction between the diazo compound and the coupler. Therefore, the color tone thus formed can be easily changed by changing the chemical structure of the diazo compound or the coupler, and an arbitrary color tone can be obtained according to the combination.

Examples of the photolytic diazo compound that is preferably used in the present invention include an aromatic diazo compound, and specific examples thereof include an aromatic diazonium salt, a diazosulfonate compound and a diazoamino compound.

Examples of the aromatic diazonium salt include compounds represented by the following structural formula but are not limited thereto. As the aromatic diazonium salt, those excellent in light fixing property, causing less coloring stain and forming a stable coloring part are preferably used.

$$Ar—N_2^+X^-$$

wherein Ar represents an aromatic hydrocarbon group having a substituent or having no substituent, $N_2^+$ represents a diazonium group, and $X^-$ represents an acid anion.

A large number of compounds are known as diazosulfonate compounds, are obtained by treating a respective diazonium salt with a sulfite, and are preferably used in the heat-sensitive recording material of the present invention.

The diazoamino compound can be obtained by coupling a diazo group with dicyandiamide, sarcosine, methyltaurine, N-ethylanthranic acid-5-sulfonic acid, monoethanolamine, diethanolamine or guanidine, and can be preferably used in the heat-sensitive recording material of the present invention.

The diazo compounds are described in detail, for example, in JP-A-2-136286.

Examples of the coupler that is subjected to the coupling reaction with the diazo compound include 2-hydroxy-3-naphthoic acid anilide, as well as the compounds described in JP-A-62-146678, such as resorcin.

In the case where the combination of the diazo compound and the coupler is used in the heat-sensitive layer, a basic substance may be added as a sensitizing agent from the standpoint that the coupling reaction can be accelerated by conducting the reaction in a basic atmosphere.

Examples of the basic substance include a water-soluble or water-insoluble basic substance or a substance that generates an alkali through heating, and for example, a nitrogen-containing compound, such as an inorganic or organic ammonium salt, an organic amine, an amide, urea or thiourea or a derivative thereof, a thiazole compound, a pyrrole compound, a pyrimidine compound, a piperazine compound, a guanidine compound, an indole compound, an imidazole compound, an imidazoline compound, a triazole compound, a morpholine compound, a piperidine compound, an amidine compound, a folimuadine compound and a pyridine compound, can be exemplified.

Specific examples thereof include those described in JP-A-61-291183.

The combination of an organic metallic salt and a reducing agent (c) will be described below.

Specific examples of the organic metallic salt include a silver salt of a long chain aliphatic carboxylic acid, such as silver laurate, silver myristate, silver palmitate, silver stearate, silver arachinate or silver behenate; a silver salt of an organic compound having an imino group, such as benzotriazole silver salt, benzimidazole silver salt, carbazole silver salt or phthaladinone silver salt; a silver salt of a sulfur-containing compound, such as S-alkylthioglycolate; a silver salt of an aromatic carboxylic acid, such as silver benzoate or silver phthalate; a silver salt of a sulfinic acid, such as silver o-toluenesulfinate; a silver salt of phosphoric acid, such as silver phenylphosphate; silver barbiturate; silver saccharate; a silver salt of salicylasdoxime; and an arbitrary mixture thereof.

Among these, a silver salt of a long chain aliphatic carboxylic acid is preferred, and silver behenate is more preferred. Behenic acid may be used in combination with silver behenate.

The reducing agent can be appropriately used based on the description of JP-A-53-1020, page 227, left lower column, line 14 to page 229, right upper column, line 11. Among these, a mono-, bis-, tris- or tetrakisphenol compound, a mono- or bisnaphthol compound, a di- or polyhydroxynaphthalene compound, a di- or polyhydroxybenzene compound, a hydroxyl monoether compound, an ascorbic acid compound, a 3-pyrazolidone compound, a pyrazoline compound, a pyrazolone compound, a reducing saccharide, a phenylenediamine compound, a hydroxylamine compound, a reductone compound, a hydroxamine compound, a hydrazide compound, an amideoxime compound and an N-hydroxyurea compound are preferably used.

Among these, an aromatic organic reducing agent, such as a polyphenol compound, a sulfoneamide phenol compound or a naphthol compound, is particularly preferred.

In order to maintain sufficient transparency of the heat-sensitive recording material, it is preferred to use the combination of the electron donative dye precursor and the electron acceptive compound (a) or the combination of the photolytic diazo compound and the coupler (b) in the heat-sensitive recording layer. In the present invention, it is preferred that one of the coloring component A and the coloring component B is used after forming into microcapsules, and it is more preferred that the electron donative dye precursor or the photolytic diazo compound is used after forming into microcapsules.

Microcapsules

A production process of the microcapsules will be described in detail below.

Examples of the production process of the microcapsules include an interface polymerization process, an internal polymerization process and an external polymerization process, all of which may be used in the present invention.

As described in the foregoing, it is preferred in the heat-sensitive recording material of the present invention that the electron donative dye precursor or the photolytic diazo compound is formed into microcapsules, and in particular, an interface polymerization process is particularly preferably employed such that the electron donative dye precursor or the photolytic diazo compound, which becomes a core of the capsules, is dissolved or dispersed in a hydrophobic organic solvent to prepare an oily phase, which is then mixed with an aqueous phase obtained by dissolving a water-soluble polymer in water, and is then subjected to emulsification and dispersion by using, for example, a homogenizer, followed by heating, so as to conduct a polymer-forming reaction at the interface of the oily droplets, whereby a microcapsule wall of a polymer substance is formed.

The reactants for forming the polymer substance are added to the interior of the oily droplets and/or the exterior of the oily droplets. Specific examples of the polymer substance include polyurethane, polyurea, polyamide, polyester, polycarbonate, a urea-formaldehyde resin, a melamine resin, polystyrene, a styrene-methacrylate copolymer and a styrene-acrylate copolymer. Among these, polyurethane, polyurea, polyamide, polyester and polycarbonate are preferred, and polyurethane and polyurea are particularly preferred.

For example, in the case where polyurea is used as the capsule wall material, the microcapsule wall can be easily formed by reacting a polyisocyanate, such as diisocyanate, triisocyanate, tetraisocyanate or a polyisocyanate prepolymer, with a polyamine, such as diamine, triamine or tetramine, a prepolymer having two or more amino groups, piperazine or a derivative thereof, or a polyol, in the aqueous phase by the interface polymerization process.

A composite wall formed with polyurea and polyamide or a composite wall formed with polyurethane and polyamide can be prepared in such amanner that, for example, apolyisocyanate and a secondary substance for forming the capsule wall through reaction therewith (for example, an acid chloride, a polyamine or a polyol) are mixed with an aqueous solution of a water-soluble polymer (aqueous phase) or an oily medium to be encapsulated (oily phase), and subjected to emulsification and dispersion, followed by heating. The production process of the composite wall formed with polyurea and polyamide is described in detail in JP-A-58-66948.

As the polyisocyanate compound, a compound having an isocyanate group of three or more functionality is preferred, and a difunctional isocyanate compound may be used in combination therewith.

Specific examples thereof include a diisocyanate, such as xylene diisocyanate or a hydrogenated product thereof, hexamethylene diisocyanate or a hydrogenated product thereof, tolylene diisocyanate or a hydrogenated product thereof and isophorone diisocyanate, as the main component; a dimer or a trimer thereof (burette or isocyanaurate); a compound having polyfunctionality as an adduct product of a polyol, such as trimethylolpropane, and a difunctional isocyanate, such as xylylene diisocyanate; a compound of an adduct product of a polyol, such as trimethylolpropane, and a difunctional isocyanate, such as xylylene diisocyanate, having a polymer compound, such as polyether having an active hydrogen, such as polyoxyethylene oxide, introduced therein; and a formalin condensation product of benzeneisocyanate.

The compounds described in JP-A-62-212190, JP-A-4-26189, JP-A-5-317694 and Japanese Patent Application No. 8-268721 are preferably used.

The polyisocyanate is preferably added in such a manner that the average particle diameter of the microcapsules is from 0.3 to 12 $\mu$m, and the thickness of the capsule wall is from 0.01 to 0.3 $\mu$m. The diameter of dispersion particles is generally about from 0.2 to 10 $\mu$m.

Specific examples of the polyol and/or the polyamine added to the aqueous phase and/or the oily phase as one constitutional component of the microcapsule wall through the reaction with the polyisocyanate include propylene glycol, glycerin, trimethylolpropane, triethanolamine, sorbitol and hexamethylenediamine. In the case where a polyol is added, apolyurethane wall is formed. In the reaction, it is preferred to increase the reaction rate by the reaction temperature being maintained high, or by an appropriate polymerization catalyst being added.

The polyisocyanate, the polyol, the reaction catalyst and the polyamine for forming a part of the wall are described in detail in known literatures, such as "Polyurethane Handbook" written by Keiji Iwata, and published by Nikkan Kogyo Shimbun, Ltd. (1987).

The microcapsule wall may further contain, depending on necessity, a metal-containing dye, a charge adjusting agent, such as nigrosin, and other arbitrary additive substances. These additives may be contained in the capsule wall upon forming the wall or at arbitrary times. In order to adjust the charging property of the surface of the capsule wall, a monomer, such as a vinyl monomer, may be graft-polymerized depending on necessity.

Furthermore, in order to make a microcapsule wall having excellent substance permeability at low temperature, to have a quality of high coloring property, it is preferred to use a plasticizer that is suitable for the polymer used as the wall material. The plasticizer preferably has a melting point of 50° C. or more, and more preferably 120° C. or more. Among plasticizers, those in a solid state at an ordinary temperature can be preferably selected.

For example, in the case where the wall material comprises polyurea or polyurethane, a hydroxyl compound, a carbamate compound, an aromatic alkoxy compound, an organic sulfoneamide compound, an aliphatic amide compound and an arylamide compound are preferably used.

As the hydrophobic organic solvent used for forming the core of the microcapsule by dissolving the electron donative dye precursor or the photolytic diazo compound upon preparing the oily phase, an organic solvent having a boiling point of from 100 to 300° C. is preferred.

Specific examples thereof include an ester compound, dimethylnaphthalene, diethylnaphthalene, diisopropylnaphthalene, dimethylbiphenyl, diisopropyldiphenyl, diisobutylbiphenyl, 1-methyl-1-dimethylphenyl-2-phenylmethane, 1-ethyl-1-dimethylphenyl-1-phenylmethane, 1-propyl-1-dimethylphenyl-1-phenylmethane, triarylmethane (such as tritoluylmethane or toluyldiphenylmethane), a terphenyl compound (such as terphenyl), an alkyl compound, an alkylated diphenyl ether (such as propyldiphenyl ether), hydrogenated terphenyl (such as hexahydroterphenyl) and diphenylterphenyl. Among these, an ester compound is particularly preferably used from the standpoint of emulsification stability of the emulsion dispersion.

Examples of the ester compound include a phosphate, such as triphenyl phosphate, tricresyl phosphate, butyl phosphate, octyl phosphate or cresylphenyl phosphate; a phthalate, such as dibutyl phthalate, 2-ethylhexyl phthalate, ethyl phthalate, octyl phthalate or butylbenzyl phthalate; dioctyl tetrahydrophthalate; a benzoate, such as ethyl benzoate, propyl benzoate, butyl benzoate, isopentyl benzoate or benzyl benzoate; an abietate, such as ethyl abietate or benzyl abietate; dioctyl adipate; isodecyl succinate; dioctyl azelate; an oxalate, such as dibutyl oxalate or dipentyl oxalate; diethyl malonate; amaleate, such as dimethylmaleate, diethyl maleate ordibutyl maleate; tributyl citrate; a sorbate, such as methyl sorbate, ethyl sorbate or butyl sorbate; a sebacate, such as dibutyl sebacate or dioctyl sebacate; an ethylene glycol ester, such as a formic acid monoester or diester, a butyric acid monoester or diester, a lauric acid monoester or diester, a palmitic acid monoester or diester, a stearic acid monoester or diester, or an oleic acid monoester or diester; triacetin; diethyl carbonate; diphenyl carbonate; ethylene carbonate; propylene carbonate; and a borate, such as tributyl borate or tripentyl borate.

Among these, it is preferred that tricresyl phosphate is used singly or as a mixture since the stability of the emulsion is in the best state. These oily substances may be used as a mixture of these oily substances or in combination with other oily substances.

In the case where the electron donative dye precursor or the photolytic diazo compound to be capsulated has poor solubility to the hydrophobic organic solvent, a low boiling point solvent having high solubility may be accessorily used in combination. Preferred examples of the low boiling point solvent include ethyl acetate, isopropyl acetate, butyl acetate and methylene chloride.

In the case where the electron donative dye precursor or the photolytic diazo compound is used in the heat-sensitive recording layer of the heat-sensitive recording material, the content of the electron donative dye precursor is preferably from 0.1 to 5.0 g/m$^2$, and more preferably from 1.0 to 4.0 g/m$^2$.

The content of the photolytic diazo compound is preferably from 0.02 to 5.0 g/m$^2$, and more preferably from 0.10 to 4.0 g/m$^2$, from the standpoint of coloring density.

When the content of the electron donative dye precursor is in the range of from 0.1 to 5.0 g/m$^2$, a sufficient coloring density can be obtained, and when the content is 5.0 g/m$^2$ or less, the sufficient coloring density can be maintained and the transparency of the heat-sensitive recording layer can be maintained.

As the aqueous phase used, an aqueous solution formed by dissolving a water-soluble polymer as a protective colloid is used. After putting the oily phase thereinto, emulsion dispersion is conducted by such means as a homogenizer, upon which the water-soluble polymer functions as a dispersion medium that makes the dispersion uniform and easy and stabilizes the aqueous solution thus emulsified and dispersed. In order to further uniformly emulsify and disperse, a surface-active agent may be added to at least one of the oily phase and the aqueous phase. As the surface-active agent, a known surface-active agent for emulsification may be used. The addition amount of the surface-active agent is preferably 0.1 to 5%, and more preferably from 0.5 to 2%, based on the weight of the oily phase.

As the surface-active agent contained in the aqueous phase, one that does not cause precipitation or aggregation through an action with the protective colloid can be used by appropriately selecting from anionic and nonionic surface-active agents.

Preferred examples of the surface-active agent include sodium alkylbenzenesulfonate, sodium alkylsulfate, sodium dioctyl sulfosuccinate and a polyalkylene glycol (such as polyoxyethylene nonylphenyl ether).

The emulsification can be easily conducted by subjecting the oily phase containing the foregoing components and the aqueous phase containing the protective colloid and the surface-active agent to a means that is generally used for fine particle emulsification, such as high speed agitation or ultrasonic wave dispersion by using a known emulsifying apparatus, such as a homogenizer, Manton Gaulin, an ultrasonic wave disperser, a dissolver or a KADY mill. After the emulsification, it is preferred that the emulsion is heated to a temperature of from 30 to 70° C. for accelerating the capsule wall-forming reaction. During the reaction, it is preferred that water is added to the emulsion to decrease the probability of collision of the capsules or that sufficient agitation is conducted to prevent aggregation of the capsules.

A dispersion for preventing aggregation may further be added during the reaction. Formation of a carbon dioxide gas is observed with progress of the reaction, and termination of the formation can be determined as completion of the capsule wall-forming reaction. In general, the reaction is conducted for several hours to obtain the objective microcapsules.

Emulsified Dispersion

In the case where the electron donative dye precursor or the photolytic diazo compound is encapsulated as the core substance, the electron acceptive compound or the coupler used may be used by solid dispersion with a water-soluble polymer, an organic base and other coloring assistants, by such means as a sand mill, but it is more preferred that these are used as an emulsion dispersion formed by previous dissolution in a high boiling point organic solvent that is only slightly water-soluble or is water-insoluble, mixing with a polymer aqueous solution (aqueous phase) containing a surface-active agent and/or a water-soluble polymer as a protective colloid, followed by emulsification, for example, by a homogenizer. In this case, a low boiling point solvent may be used as a dissolving assistant depending on necessity.

Furthermore, the coupler and the organic base may be separately subjected to emulsion dispersion, and also may be dissolved in a high boiling point solvent after mixing, followed by subjecting to emulsion dispersion. The emulsion dispersion particle diameter is preferably 1 $\mu$m or less.

In this case, the high boiling point organic solvent used can be appropriately selected, for example, from the high boiling point oils described in JP-A-2-141279.

Among these, the use of an ester compound is preferred from the standpoint of emulsion stability of the emulsion dispersion, and tricresyl phosphate is particularly preferred. The oils may be used as a mixture thereof and as a mixture with other oils.

The water-soluble polymer contained as the protective colloid can be appropriately selected from known anionic polymers, nonionic polymers and amphoteric polymers. The water-soluble polymer has a solubility of 5% or more in water at a temperature at which the emulsification is to be conducted. Specific examples thereof include polyvinyl alcohol and a modified product thereof, polyacrylic amide and a derivative thereof, an ethylene-vinyl acetate copolymer, a styrene-maleic anhydride copolymer, an ethylene-maleic anhydride copolymer, an isobutylene-maleic anhydride copolymer, polyvinyl pyrrolidone, an ethylene-acrylic acid copolymer, a vinyl acetate-acrylic acid copolymer, a cellulose derivative, such as carboxymethyl cellulose and methyl cellulose, casein, gelatin, a starch derivative, gum arabic and sodium alginate.

Among these, polyvinyl alcohol, gelatin and a cellulose derivative are particularly preferred.

The mixing ratio of the oily phase to the aqueous phase (oily phase weight/aqueous phase weight) is preferably from 0.02 to 0.6, and more preferably from 0.1 to 0.4. When the mixing ratio is in the range of from 0.02 to 0.6, a suitable viscosity can be maintained, and thus the production adequacy and the stability of the coating composition become excellent.

In the case where an electron acceptive compound is used in the heat-sensitive recording material of the present invention, the amount of the electron acceptive compound is preferably from 0.5 to 30 parts by weight, and more preferably from 1.0 to 10 parts by weight, per 1 part by weight of the electron donative dye precursor.

In the case where the coupler is used in the heat-sensitive recording material of the present invention, the amount of the coupler is preferably from 0.1 to 30 parts by weight per 1 part by weight of the diazo compound.

Heat-sensitive Recording Layer Coating Composition

The heat-sensitive recording layer coating composition can be prepared by mixing the microcapsule composition and the emulsion dispersion thus prepared as described in the foregoing. The water-soluble polymer used as the protective colloid upon preparation of the microcapsule composition and the water-soluble polymer used as the protective colloid upon preparation of the emulsion dispersion function as a binder of the heat-sensitive recording layer. The heat-sensitive recording layer coating composition may also be prepared by adding and mixing a binder separately from the protective colloids.

As the binder added, one with water solubility is generally used, and examples thereof include polyvinyl alcohol, hydroxyethyl cellulose, hydroxypropyl cellulose, epichlorohydrin-modified polyamide, an ethylene-maleic anhydride copolymer, a styrene-maleic anhydride copolymer, an isobutylene-maleic salicylic anhydride copolymer, polyacrylic acid, polyacrylic amide, methylol-modified polyacrylamide, a starch derivative, casein and gelatin.

In order to impart water resistance to the binder, a water resisting agent may be added thereto, and an emulsion of a hydrophobic polymer, specifically a styrene-butadiene rubber latex, or an acrylic resin emulsion, may be added thereto.

A known coating method applied to an aqueous or organic solvent series coating composition is used for coating the heat-sensitive recording layer coating composition on a support. In order to safely and uniformly coat the heat-sensitive recording layer coating composition and to maintain the strength of the coated film, the heat-sensitive recording material of the present invention may contain methyl cellulose, carboxymethyl cellulose, hydroxyethyl cellulose, a starch compound, gelatin, polyvinyl alcohol, carboxyl-modified polyvinyl alcohol, polyacrylamide, polystyrene or a copolymer thereof, polyester or a copolymer thereof, polyethylene or a copolymer thereof, an epoxy resin, an acrylate series resin or a copolymer thereof, a methacrylate series resin or a copolymer thereof, a polyurethane resin, a polyamide resin or a polyvinyl butyral resin.

Other Components

The other components that can be used in the heat-sensitive recording layer will be described below.

The other components are not particularly limited and can be appropriately selected depending on necessity, and examples thereof include a known thermal melting agent, a known ultraviolet ray absorbing agent and a known antioxidant.

The thermal melting agent may be contained in the heat-sensitive recording layer in order to improve the thermal responsiveness.

Examples of the thermal melting agent include an aromatic ether, a thioether, an ester, an aliphatic amide and an ureide.

Specific examples thereof are described in JP-A-58-57989, JP-A-58-87094, JP-A-61-58789, JP-A-62-109681, JP-A-62-132674, JP-A-63-151478, JP-A-63-235961, JP-A-2-184489 and JP-A-2-215585.

Preferred examples of the ultraviolet ray absorbing agent include a benzophenone series ultraviolet ray absorbing agent, a benzotriazole series ultraviolet ray absorbing agent, a salicylic acid series ultraviolet ray absorbing agent, a cyanoacrylate series ultraviolet ray absorbing agent and an oxalic acid anilide series ultraviolet ray absorbing agent. Specific examples thereof are described in JP-A-47-10537, JP-A-58-111942, JP-A-58-212844, JP-A-59-19945, JP-A-59-46646, JP-A-59-109055, JP-A-63-53544, JP-B-36-10466, JP-B-42-26187, JP-B-48-30492, JP-B-48-31255, JP-B-48-41572, JP-B-48-54965, JP-B-50-10726, U.S. Pat. No. 2,719,086, U.S. Pat. No. 3,707,375, U.S. Pat. No. 3,754,919 and U.S. Pat. No. 4,220,711.

Preferred examples of the antioxidant include a hindered amine series antioxidant, a hindered phenol series antioxidant, an aniline series antioxidant and a quinoline series antioxidant. Specific examples thereof are described in JP-A-59-155090, JP-A-60-107383, JP-A-60-107384, JP-A-61-137770, JP-A-61-139481 and JP-A-61-160287.

The coating amount of the other components is preferably from 0.05 to 1.0 g/m$^2$, and more preferably from 0.1 to 0.4 g/m$^2$. The other components may be added inside the microcapsules or may be added outside the microcapsules.

In order to suppress density unevenness caused by a minute difference in thermal conductivity of the thermal head and obtain an image of high quality, the heat-sensitive recording layer preferably has a wide energy amount range necessary for obtaining saturated transmission density ($D_{T-max}$), i.e., preferably has a wide dynamic range. The heat-sensitive recording material of the present invention has the foregoing heat-sensitive recording layer, which is preferably a heat-sensitive recording layer having such characteristics that a transmission density $D_T$ of 3.0 by a thermal energy amount in the range of from 90 to 150 mJ/mm$^2$.

It is preferred that the heat-sensitive recording layer is coated to have a dry coating amount of from 1 to 25 g/m$^2$ after drying and is coated to have a thickness of the layer of from 1 to 25 $\mu$m. The heat-sensitive recording layer may be used by accumulating two or more layers. In this case, the dry coating amount of all the heat-sensitive recording layers is preferably from 1 to 25 g/m$^2$ after coating and drying.

Support

In order to obtain a transparent heat-sensitive recording material, a transparent support is preferably used in the heat-sensitive recording material of the present invention. Examples of the transparent support include a synthetic polymer film, examples of which include a polyester film, such as polyethyleneterephthalate or polybutyleneterephthalte, a cellulose triacetate film, and a polyolefin film, such as polypropylene or polyethylene, which can be used singly or in a combination of two or more by lamination.

The thickness of the synthetic polymer film is preferably 25 to 250 $\mu$m, and more preferably from 50 to 200 $\mu$m.

The synthetic polymer film may be colored to an arbitrary color tone. Examples of the method for coloring the polymer film include a method in which a dye is mixed with a resin before forming the resin film, followed by being formed into a film, and a method in which a dye is dissolved in an appropriate solvent to form a coating solution, which is then coated on a colorless transparent resin film by a known coating method, such as a gravure coating method, a roller coating method or a wire coating method. Among these, a film is preferred that is prepared in such a manner that polyethylene terephthalate or polyethylene naphthalate having a blue dye mixed and kneaded therein is formed into a film, which is then subjected to a heat resistant treatment, a stretching treatment and an antistatic treatment.

Particularly, in the case where the transparent heat-sensitive recording material of the present invention is observed from the side of the support on a light box, there are cases where glare is caused by light box light transmitted through a transparent non-image part.

In order to avoid such a phenomenon, it is particularly preferred to use, as the transparent support, a synthetic polymer film that is colored blue in a rectangular region formed by four points, A (x=0.2805, y=0.3005), B (x=0.2820, y=0.2970), C (x=0.2885, y=0.3015) and D (x=0.2870, y=3040), on the chromaticity coordinates defined by the method of JIS Z8701.

Other Layers

The heat-sensitive recording material of the present invention may further comprise, on the support, other layers, such as an intermediate layer, an undercoating layer, an ultraviolet ray filtering layer and a light reflection preventing layer.

Intermediate Layer

The intermediate layer is preferably formed on the heat-sensitive recording layer.

The intermediate layer is provided for preventing mixing of the layers and for blocking a gas (such as oxygen) that is harmful for image preserving property. A binder used therein is not particularly limited, and polyvinyl alcohol, gelatin, polyvinyl pyrrolidone and a cellulose derivative can be used depending on the system used. In order to impart coating suitability, various kinds of surface-active agents may be added. In order to further improve the gas blocking property, inorganic fine particles, such as mica, may be added in an amount of from 2 to 20% by weight, more preferably from 5 to 10% by weight, based on the amount of the binder.

Undercoating Layer

In the heat-sensitive recording material of the present invention, an undercoating layer maybe provided on the support before coating the heat-sensitive recording layer containing the microcapsules and the light reflection preventing layer, in order to prevent release of the heat-sensitive recording layer from the support.

As the undercoating layer, an acrylate copolymer, polyvinylidene chloride, SBR or an aqueous polyester can be used, and the thickness of the layer is preferably from 0.05 to 0.5 $\mu$m.

There are cases where, upon coating the heat-sensitive recording layer on the undercoating layer, the undercoating layer is swollen by the water content contained in the heat-sensitive recording layer coating composition to deteriorate the image recorded on the heat-sensitive recording layer, and therefore it is preferred that the undercoating layer is hardened with a hardening agent, such as a dialdehyde compound, e.g., glutaraldehyde or 2,3-dihydroxy-1,4-dioxane, and boric acid. The addition amount of the hardening agent is appropriately determined depending on the material of the undercoating layer and selected from the range of from 0.2 to 3.0% by weight corresponding to a desired hardening degree.

Ultraviolet Ray Filtering Layer

An ultraviolet ray filtering layer may be provided on the back surface of the support opposite to the surface, on which the heat-sensitive recording layer is coated, in order to prevent color degradation of an image. The ultraviolet ray filtering layer contains an ultraviolet ray absorbing agent, such as a benzotriazole series, a benzophenone series or a hindered amine series.

Light Reflection Preventing Layer

A light reflection preventing layer containing fine particles having an average particle diameter of from 1 to 20 $\mu$m, preferably from 1 to 10 $\mu$m, may be provided on the back surface of the support opposite to the surface, on which the heat-sensitive recording layer is coated.

It is preferred that the gloss measured with an incident light angle of 20° is decreased to 50% or less, and more preferably 30% or less, by providing the light reflection preventing layer.

Examples of the fine particles contained in the light reflection preventing layer include fine particles of starch obtained from barley, wheat, corn, rice or beans; fine particles of a synthetic polymer, such as cellulose fibers, a polystyrene resin, an epoxy resin, a polyurethane resin, a urea formalin resin, a poly(meth)acrylate resin, a polymethyl (meth)acrylate resin, or a copolymer resin of vinyl chloride and vinyl acetate; and fine particles of an inorganic material, such as calcium carbonate, titanium oxide, kaolin, smectite clay, aluminum hydroxide, silica or zinc oxide.

These may be used singly or in a combination of two or more. The layer is preferably a fine particle substance having a refractive index of from 1.45 to 1.75 from the standpoint that the transparency of the heat-sensitive recording material is maintained.

Thermal Head

It is preferred that the thermal head used in the heat-sensitive recording process of the present invention is prepared by providing a protective layer on a heating element comprising a glazing layer having thereon a heating resistance element and an electrode by using a known film-forming apparatus, whereby the thermal head has the uppermost layer having a carbon content of 90% or more, which is in contact with the heat-sensitive recording layer. In this embodiment, a head-protective layer may comprise two or more layers, and at least the uppermost layer has a carbon content of 90% or more.

The heat-sensitive recording material of the present invention can be preferably produced by the production process of a heat-sensitive recording material of the present invention described below, but it is not limited thereto, and the heat-sensitive recording material of the present invention can be produced by other processes.

Because the heat-sensitive recording material of the present invention contains the particular amide compound in the protective layer, it is unlikely to cause sticking and noise upon printing, and has sufficient head-matching property to a thermal head having an uppermost layer excellent in wearing resistance having a carbon content of 90% or more, and therefore, the material is particularly preferably used in a field in which high image quality is demanded, such as a medical recording medium.

The production process of the heat-sensitive recording medium of the present invention will be described below.

The production process of a heat-sensitive recording material of the present invention includes the steps of: coating a heat-sensitive recording layer coating composition on the support to form the heat-sensitive recording layer; coating a protective layer coating composition on the heat-sensitive recording layer to form a protective layer; and forming, depending on necessity, other layers.

The heat-sensitive recording layer and the protective layer may be formed simultaneously with each other, and in this case, the heat-sensitive recording layer coating composition and the protective layer coating composition are simultaneously subjected to multilayer coating, whereby the heat-sensitive recording layer and the protective layer can be simultaneously formed.

As the support used herein, the support described for the heat-sensitive recording material of the present invention can be used. As the heat-sensitive recording layer coating composition used herein, the heat-sensitive recording layer coating composition described in the foregoing can be used, and as the protective layer coating composition used herein, the protective layer coating composition containing the pigment and binder described in the foregoing can be used.

Examples of the other layers include the intermediate layer, the undercoating layer and the other layers described in the foregoing.

In the production process of the heat-sensitive recording material of the present invention, a known coating method can be used for sequentially coating the undercoating layer, the heat-sensitive recording layer, the intermediate layer and the protective layer on the support, and examples of the coating method include a blade coating method, an air knife coating method, a gravure coating method, a roll coating method, a spray coating method, a dip coating method and a bar coating method.

According to the production process of the heat-sensitive recording material of the present invention, the heat-sensitive recording material of the present invention can be produced.

EXAMPLES

The present invention will be described in more detail with reference to the Examples below, but the present invention is not limited thereto.

Example 1

Preparation of Protective Layer Coating Composition

Preparation of Pigment Dispersion for Protective Layer 30 g of stearic acid-treated aluminum hydroxide (Heidilite H24S, a trade name, produced by Showa Denko Co., Ltd.) as a pigment was added to 110 g of water, and then 0.8 g of a dispersion assistant (Poiz 532A, a trade name, produced by Kao Corp.) 30 g of a 10% by weight aqueous solution of polyvinyl alcohol (PVA105, a trade name, produced by Kuraray Co., Ltd.) and 10 g of an aqueous solution of the compound represented by the following structural formula (100) adjusted to have a concentration of 2% by weight were added thereto, followed by dispersion by a sand mill, to obtain a pigment dispersion for a protective layer having an average particle diameter of 0.30 $\mu$m.

The "average particle diameter" herein was a 50% average particle diameter measured in the following manner. The pigment used was dispersed in the presence of the dispersion assistant, and water was added to the pigment dispersion immediately after dispersion to dilute to a concentration of 0.5% by weight, so as to prepare a test liquid. The test liquid was put in warm water at 40° C. to adjust the light transmittance to 75±1.0%, and subjected to an ultrasonic wave treatment for 30 seconds, followed by being measured by a laser diffraction particle size distribution measuring apparatus (LA700, a trade name, produced by Horiba, Ltd.). All the average particle diameters referred to herein are average particle diameters measured in the foregoing manner.

Preparation of Protective Layer Coating Composition $$CH_3(CH_2)_7CH{=}CH(CH_2)_7{-}CON(CH_3){-}CH_2CH_2SO_3Na \quad (100)$$

Preparation of Heat-Sensitive Recording Layer Coating Composition

| | |
|---|---|
| Polyvinyl alcohol aqueous solution (8% by weight) (PVA124C, a trade name, produced by Kuraray Co., Ltd.) | 90 g |
| Lead stearate dispersion (20.5% by weight) (F155, a trade name, produced by Chukyo Yushi Co., Ltd.) | 5.5 g |
| Stearic amide compound (21.5% by weight) (G-270, a trade name, produced by Chukyo Yushi Co., Ltd.) | 3.8 g |
| Stearic acid (18.0% by weight) (Cellozole 920, a trade name, produced by Chukyo Yushi Co., Ltd.) | 2.8 g |
| Boric acid aqueous solution (40%) | 10 g |
| Pigment dispersion for protective layer (prepared in the foregoing, 18% by weight) | 70 g |
| Silicone oil aqueous dispersion (35% by weight) (polydimethylsiloxane, BY22-840, a trade name, produced by Toray Dow Corning Co., Ltd.) | 4.7 g |
| Sodium dodecylbenzene sulfonate aqueous solution (10% by weight) | 6.5 g |
| Styrene-maleic acid copolymer ammonium salt aqueous solution (6% by weight) (Polymalon 385, a trade name, produced by Arakawa Chemical Industries, Ltd.) | 17.5 g |
| 20% Colloidal silica (Snowtex, a trade name, produced by Nissan Chemical Industries, Ltd.) | 14 g |
| 10% Surfron S131S | 16 g |

-continued

| | |
|---|---|
| (a trade name, produced by Seimi Chemical Co., Ltd.) | |
| Plysurf A217 | 1.1 g |
| (a trade name, produced by Dai-icho Kogyo Seiyaku Co., Ltd.) | |
| 2% Acetic acid | 8 g |

Microcapsule coating compositions and developer emulsion dispersions were prepared in the following manner.

Preparation of Microcapsule Coating Composition A

The following components as coloring agents were added to 24.3 g of ethyl acetate and dissolved by heating to 70° C., followed by cooling to 45° C. 13.1 g of a capsule wall material (Takenate D140N, a trade name, produced by Takeda Chemical Industries, Ltd.) and 2.3 g of Barnoc D750 (a trade name, produced by Dainippon Ink and Chemicals, Inc.) were added thereto and mixed.

| | |
|---|---|
| Compound represented by the following structural formula (201) | 11.7 g |
| Compound represented by the following structural formula (202) | 1.5 g |
| Compound represented by the following structural formula (203) | 2.2 g |
| Compound represented by the following structural formula (204) | 5.65 g |
| Compound represented by the following structural formula (205) | 1.2 g |
| Compound represented by the following structural formula (206) | 1.1 g |
| Compound represented by the following structural formula (207) | 0.57 g |

(201)

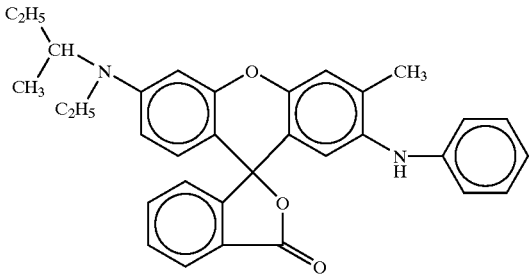

(202)

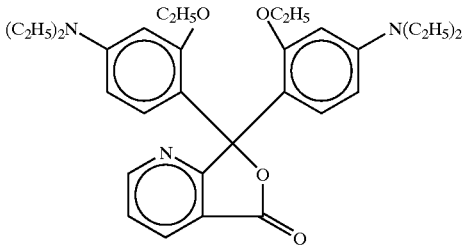

(203)

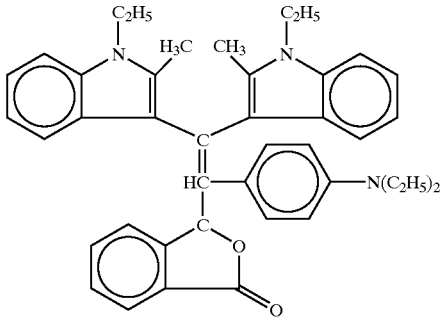

-continued

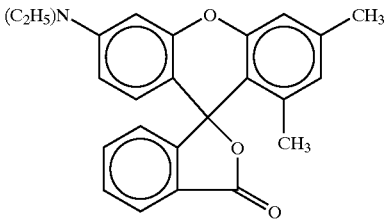

(204)

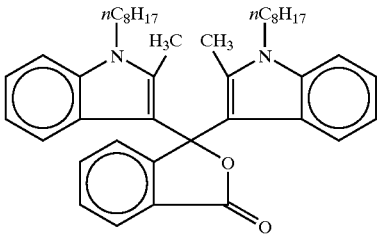

(205)

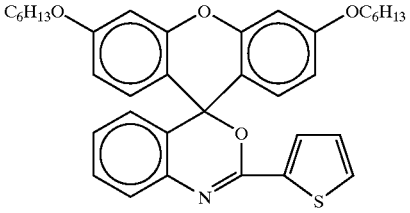

(206)

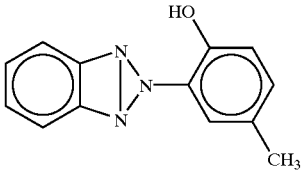

(207)

The resulting solution was put in an aqueous phase formed by mixing 16 g of water and 48 g of a polyvinyl alcohol aqueous solution of 8% by weight (PVA 217C, a trade name, produced by Kuraray Co., Ltd.), and emulsification was conducted by using an Ace Homogenizer (a trade name, produced by Nippon Seiki Co., Ltd.) at a rotation speed of 15,000 rpm for 5 minutes. 110 g of water and 1.0 g of tetraethylene pentamine were added to the resulting emulsion, and a capsulation reaction was conducted at 60° C. for 4 hours, so as to prepare a microcapsule coating composition having an average particle diameter of 0.35 $\mu$m.

Preparation of Microcapsules B

The following components were added to 21 g of ethyl acetate and dissolved by heating to 70° C., followed by cooling to 35° C. 0.5 g of n-butanol, 14.1 g of Takenate D127N (produced by Takeda Chemical Industries, Ltd.) and 2.5 g of Takenate D110ON (produced by Takeda Chemical Industries, Ltd.) were added thereto, and maintained at 35° C. for 40 minutes.

| | |
|---|---|
| Compound represented by the aforementioned structural formula (201) | 12.2 g |
| Compound represented by the aforementioned structural formula (202) | 1.6 g |
| Compound represented by the aforementioned structural formula (203) | 2.4 g |

-continued

| | |
|---|---|
| Compound represented by the aforementioned structural formula (204) | 3.3 g |
| Compound represented by the aforementioned structural formula (205) | 1.5 g |
| Compound represented by the aforementioned structural formula (206) | 0.2 g |
| Compound represented by the aforementioned structural formula (207) | 0.5 g |

The resulting solution was put in an aqueous phase formed by mixing 16.6 g of water and 48 g of a polyvinyl alcohol aqueous solution of 8% by weight (PVA 217C, a trade name, produced by Kuraray Co., Ltd.), and emulsification was conducted by using an Ace Homogenizer (a trade name, produced by Nippon Seiki Co., Ltd.) at a rotation speed of 15,000 rpm for 5 minutes. 112 g of water and 0.9 g of tetraethylene pentamine were added to the resulting emulsion, and a capsulation reaction was conducted at 60° C. for 4 hours, so as to prepare a microcapsule coating composition having an average particle diameter of 0.35 $\mu$m.

Preparation of Developer Emulsion Dispersion

The following components were added to 16.5 g of ethyl acetate along with 1.0 g of tricresyl phosphate and 0.5 of diethyl maleate and dissolved by heating to 70° C.

| | |
|---|---|
| Compound represented by the following structural formula (301) | 6.7 g |
| Compound represented by the following structural formula (302) | 8.0 g |
| Compound represented by the following structural formula (303) | 5.8 g |
| Compound represented by the following structural formula (304) | 1.5 g |
| Compound represented by the following structural formula (305) | 2.2 g |
| Compound represented by the following structural formula (306) | 0.8 g |
| Compound represented by the following structural formula (307) | 4.3 g |

(301)

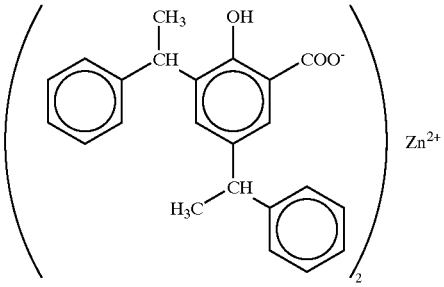

(302)

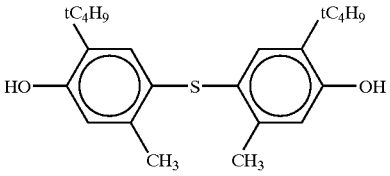

(303)

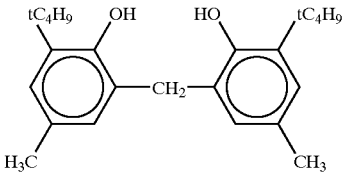

(304)

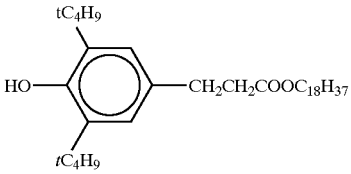

(305)

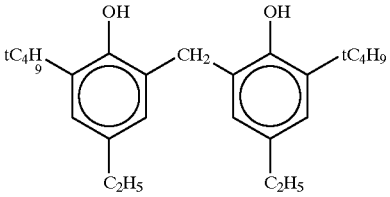

(306)

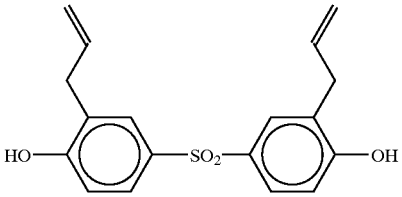

-continued (307)

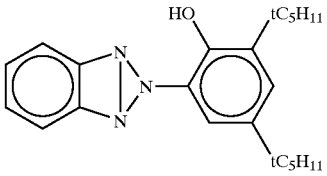

The resulting solution was put in an aqueous phase formed by mixing 70 g of water, 57 g of a polyvinyl alcohol aqueous solution of 8% by weight (PVA 217C, a trade name, produced by Kuraray Co., Ltd.), 20 g of a polyvinyl alcohol aqueous solution of 15% by weight (PVA 205C, a trade name, produced by Kuraray Co., Ltd.) and 11.5 g of a 2% by weight aqueous solution of the compound represented by the following structural formula (401) and the compound represented by the following structural formula (402), and emulsification was conducted by using an Ace Homogenizer (a trade name, produced by Nippon Seiki Co., Ltd.) at a rotation speed of 10,000 rpm, so as to obtain a developer emulsion dispersion.

(401)

$C_{12}H_{25}SO_3Na$ (402)

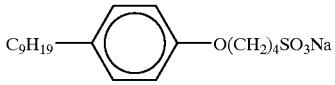

Preparation of Heat-sensitive Recording Layer Coating Composition A 12 g of the microcapsule coating composition A (solid concentration: 23% by weight), 2.5 g of the microcapsules B (24%), 50 g of the developer emulsion dispersion (solid concentration: 22% by weight), 0.7 g of a 50% by weight aqueous solution of the compound represented by the following structural formula (403) and 1.8 g of colloidal silica (Snowtex, a trade name, produced by Nissan Chemical Industries, Ltd.) were mixed to prepare a heat-sensitive recording layer coating composition A.

(403)

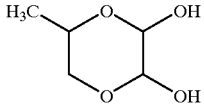

Preparation of Heat-Sensitive Recording Layer Coating Composition B

The following components were mixed to prepare a heat-sensitive recording layer coating composition B.

| | |
|---|---|
| Microcapsules A (23%) | 2.3 g |
| Microcapsules B (24%) | 6.6 g |
| Developer (22%) | 33 g |
| Colloidal silica (Snowtex, a trade name, produced by Nissan Chemicals Industries, Ltd.) | 1.5 g |
| Compound represented by the structural formula (403) | 0.4 g |

Preparation Of Heat-sensitive Recording Layer Coating Composition C 35 g of a polyvinyl alcohol aqueous solution of 6% by weight (PVA 124C, a trade name, produced by Kuraray Co., Ltd.), 2 g of a 2% aqueous solution of the compound represented by the following structural formula (404) and 0.5 g of the microcapsules A (23%) were dissolved in 5 g of water to prepare a heat-sensitive recording layer coating composition C.

(404)

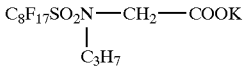

Preparation of BC Layer (Back Layer) Coating Composition 1 kg of lime-treated gelatin, 757 g of a gelatin dispersion containing 12% by weight of a spherical PMMA matt agent having an average particle diameter of 5.7 μm and 3,761 g of an emulsion of ultraviolet ray absorbing agents containing the compounds represented by the following structural formulae (501) to (506) in the following proportions were mixed to prepare a BC layer coating composition. The contents of the ultraviolet ray absorbing agents per 1 kg of the emulsion were as follows.

| | |
|---|---|
| Compound represented by the structural formula (501) | 9.8 g |
| Compound represented by the structural formula (502) | 8.4 g |
| Compound represented by the structural formula (503) | 9.8 g |
| Compound represented by the structural formula (504) | 13.9 g |
| Compound represented by the structural formula (505) | 29.3 g |
| 1,2-benzisothiazolin-3-one | 1.75 g |
| poly(p-vinylbenzenesulfonate) (molecular weight: 400,000) | 64.2 g |
| Compound represented by the structural formula (506) | 10.0 g |
| N,N-ethylene-bis(vinylsulfonylacetoamide)propane | 25.0 g |

Further, water was added so that the total volume of the mixture become 62.77 liter.

(501)

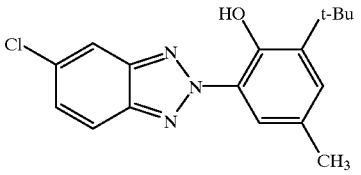

(502)

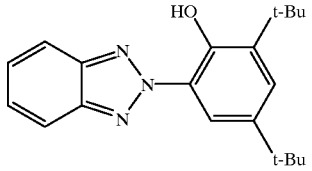

(503)

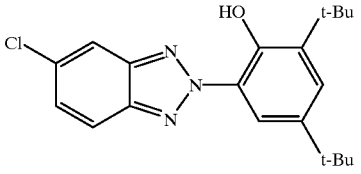

-continued (504)

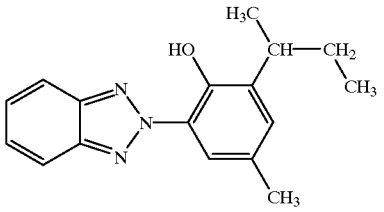

(505)

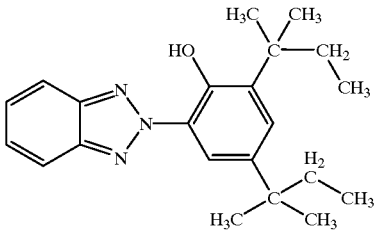

(506)

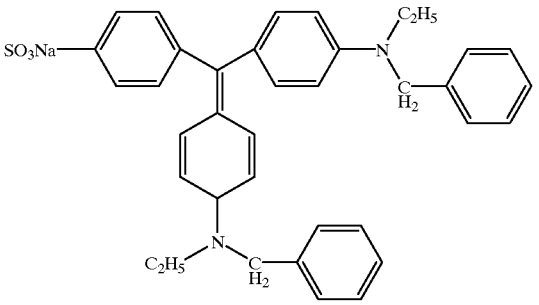

Preparation of BPC Layer (Back Protective Layer) Coating Composition 1 kg of lime-treated gelatin, 2,000 g of a gelatin dispersion containing 15% by weight of a spherical PMMA matt agent having an average particle diameter of 0.70 μm, 1,268 ml of methanol, 1.75 g of 1,2-benzisothiazolin-3-one, 64.4 g of sodium polyacrylic acid (molecular weight: ca. 100,000), 54.0 g of sodium poly(p-vinylbenzenesulfonate) (molecular weight: ca. 400,000), 25.2 g of sodium p-t-octylphenoxypolyoxiethylene ethyl sulfonate, 5.3 g of sodium N-propyl-N-polyoxyethylene perfluorooctanesulfonic amide butyl sulfonate and 7.1 g of potassium perfluorooctane sulfonate were mixed and adjusted with caustic soda to have pH 7.0, and water was added thereto to make 66.79 L in total, so as to prepare a BPC layer coating composition.

The BC layer coating composition and the BPC layer coating composition were coated on a transparent PET support (thickness: 180 μm) having been dyed to have a blue color of x=0.2850 and y=0.2995 in the chromaticity coordinates defined by the method of JIS Z8701, in the order of the BC layer coating composition and the BPC layer coating composition from the side of the support with coating amounts of 44.0 ml/m$^2$ and 18.5 ml/m$^2$, respectively, followed by drying.

Production of Heat-Sensitive Recording Material

On the support having the BC layer coated thereon, at a side thereof opposite to the side of the BC layer, the heat-sensitive layer coating compositions A, B and C and the protective layer coating composition were coated in this order from the support to coating amounts of 50 ml/m$^2$, 20 ml/m$^2$, 25 ml/m$^2$ and 25 ml/m$^2$, respectively, followed by drying, so as to obtain a transparent heat-sensitive recording material according to the present invention.

Evaluation of Head-Matching Property

The resulting heat-sensitive recording material was subjected to recording using a thermal head (KGT, 260–12 MPH8, a trade name, produced by Kyocera Corp.) at a head pressure of 10 kg/cm$^2$ and recording energy of 120 mJ/mm$^2$, and occurrence of sticking, in which the thermal head and the protective layer of the heat-sensitive recording material adhered duing printing, was evaluated visually. A specimen causing no sticking was evaluated to grade A, a specimen causing sticking that was observable with a loupe but caused no practical problems was evaluated to grade B, a specimen causing sticking that was observable with a loupe and involved a possibility of practical problems was evaluated to grade C, and a specimen causing sticking that was observable with the naked eye was evaluated to grade D.

The printing noise upon printing was measured by an M-06 produced by Dion Co., Ltd. at a background noise of 52 dB and a distance from the head of 1 m.

The same evaluations were conducted by using the same thermal head except that a carbon layer having a thickness of 2 $\mu$m and a carbon content of 98% had been formed on the thermal head as the uppermost layer. The results obtained are shown in Table 1.

Example 2

A heat-sensitive recording material was produced in the same manner as in Example 1 except that 2.9 g of ethylene bisstearoamide (28% by weight) (B961, a trade name, produced by Chukyo Yushi Co., Ltd.) was used instead of the 3.8 g of stearic amide (21.5% by weight) (G270, a trade name, produced by Chukyo Yushi Co., Ltd.) in the preparation of the protective layer coating composition, and was evaluated in the same manner as in Example 1.

Example 3

A heat-sensitive recording material was produced in the same manner as in Example 1 except that 3.7 g of methylol stearoamide (22% by weight) (D130, a trade name, produced by Chukyo Yushi Co., Ltd.) was used instead of the 3.8 g of stearic amide (21.5% by weight) (G270, a trade name, produced by Chukyo Yushi Co., Ltd.) in the preparation of the protective layer, and was evaluated in the same manner as in Example 1.

Example 4

A heat-sensitive recording material was produced in the same manner as in Example 1 except that 5.1 g of a liquid obtained by mixing the following components, followed by being dispersed by a sand mill to an average particle diameter of 1.0 $\mu$m was used instead of the 3.8 g of stearic amide (21.5% by weight) (G270, a trade name, produced by Chukyo Yushi Co., Ltd.) in the preparation of the protective layer, and was evaluated in the same manner as in Example 1.

| | |
|---|---|
| Oleic amide<br>(Alflow E-10, a trade name, produced by NOF Corp.) | 10 g |
| 10% Polyvinyl alcohol<br>(PUA105, a trade name, produced by Kuraray Co., Ltd.) | 20 g |
| 2% Dodecylbenzene sodium sulfonate aqueous solution | 5 g |
| Water | 25 g |

Example 5

Production and evaluation were conducted in the same manner as in Example 4 except that m-xylylene bisstearic amide (Alflow AD876, a trade name, produced by NOF Corp.) was used instead of the oleic amide.

Comparative Example 1

A heat-sensitive recording material was produced in the same manner as in Example 1 except that the stearic amide used in the preparation of the protective layer coating composition in Example 1 was not used, and was evaluated in the same manner as in Example 1.

TABLE 1

| | | Test 1 Kyocera KGT Head | | Test 2 Head with carbon surface layer | |
|---|---|---|---|---|---|
| | Amide compound | Sticking | Noise (dB) | Sticking | Noise (dB) |
| Example 1 | Stearic amide | A | 55 | A | 58 |
| Example 2 | Ethylene bisstearoamide | A | 56 | A | 59 |
| Example 3 | Methylol stearoamide | A | 55 | A | 58 |
| Example 4 | Oleic amide | A | 55 | A | 59 |
| Example 5 | m-Xylylene bisstearic amide | A | 56 | B | 59 |
| Comparative Example 1 | none | C | 61 | D | 67 |

It was understood from the results shown in Table 1 that heat-sensitive recording materials that did not cause sticking with both the ordinary head and the carbon head could be obtained in the Examples, but sticking causing practical problems occurred in Comparative Example 1. Furthermore, the recording noise upon recording with the carbon head in Comparative Example 1 was as high as 67 dB, which was not suitable for use in the medical field, but in all Examples, the noise was as low as 60 dB or less, which would cause no problem.

Evaluation of Transportation Torque

The heat-sensitive recording materials were subjected to recording using a thermal head (KGT, 260–12 MPH8, a trade name, produced by Kyocera Corp.) at a head pressure of 10 kg/cm$^2$ with varied energy. The transmission density of a recorded part was measured for the relationship between the energy and the optical transmission density (ODv) with a TD904 Transmission Densitometer with a visual filter from Macbeth Corp., and a coloring starting energy (energy at ODv-Fog ODv=0.01) and an energy providing an ODv of 3.0 were obtained, which were designated as $E_1$ and $E_2$, respectively. A torsion bar was engaged between a platen roll and a transportation motor, and $E_1$ and $E_2$ were measured with a torque meter (Load Torquemeter II, a trade name, produced by Vibrac Corp. (Amherst, N.H., U.S.A.)) through the torsion bar. The measurement results of $E_1$ and $E_2$ are shown in Table 2.

Measurement of Density Variation

An image pattern shown in FIG. 1 was prepared, and density unevenness was evaluated visually at the positions A and B, where the applied energy was greatly changed. The evaluation results are shown in Table 3.

Example 6

A heat-sensitive recording material was produced in the same manner as in Example 1 except that 17.5 g of a styrene-acrylamide copolymer aqueous solution (6%) (Polymalon 1329, a trade name, produced by Arakawa Chemical Industries, Ltd.) was used instead of the 17.5 g of a styrene-maleic acid copolymer ammonium salt aqueous solution (6%) (Polymalon 385, a tradename, produced by Arakawa Chemical Industries, Ltd.) in the preparation of the protective layer coating composition, and was evaluated in the same manner as in Example 1.

Example 7

A heat-sensitive recording material was produced in the same manner as in Example 1 except that 17.5 g of ammonium styrene sulfonate (6%) (Chemistat SA109, a trade name, produced by Sanyo Chemical Industries, Ltd.) was used instead of the 17.5 g of a styrene-maleic acid copolymer ammonium salt aqueous solution (6%) (Polymalon 385, a trade name, produced by Arakawa Chemical Industries, Ltd.) in the preparation of the protective layer coating composition, and was evaluated in the same manner as in Example 1.

Example 8

A heat-sensitive recording material was produced in the same manner as in Example 1 except that 17.5 g of a styrene-maleic acid acrylamide aqueous solution (6%) (SS207, a trade name, produced by Kindai Kagaku Co., Ltd.) was used instead of the 17.5 g of a styrene-maleic acid copolymer ammonium salt aqueous solution (6%) (Polymalon 385, a trade name, produced by Arakawa Chemical Industries, Ltd.) in the preparation of the protective layer coating composition, and was evaluated in the same manner as in Example 1.

Example 9

A heat-sensitive recording material was produced in the same manner as in Example 1 except that 17.5 g of a styrene-maleic acid copolymer ammonium salt aqueous solution (6%) (ratio of styrene/maleic acid: 9/1, produced by Kindai Kagaku Co., Ltd.) was used instead of the 17.5 g of a styrene-maleic acid copolymer ammonium salt aqueous solution (6%) (ratio of styrene/maleic acid: 1/1, Polymalon 385, a trade name, produced by Arakawa Chemical Industries, Ltd.) in the preparation of the protective layer coating composition, and was evaluated in the same manner as in Example 1.

Example 10

A heat-sensitive recording material was produced in the same manner as in Example 1 except that 17.5 g of a styrene-maleic acid copolymer ammonium salt aqueous solution (6%) (ratio of styrene/maleic acid: 4/6, produced by Kindai Kagaku Co., Ltd.) was used instead of the 17.5 g of a styrene-maleic acid copolymer ammonium salt aqueous solution (6%) (ratio of styrene/maleic acid: 1/1, Polymalon 385, a trade name, produced by Arakawa Chemical Industries, Ltd.) in the preparation of the protective layer coating composition, and was evaluated in the same manner as in Example 1.

Comparative Example 2

A heat-sensitive recording material was produced in the same manner as in Example 1 except that the styrene-maleic acid copolymer ammonium salt aqueous solution (6%) (Polymalon 385, a trade name, produced by Arakawa Chemical Industries, Ltd.) was not used in the preparation of the protective layer coating composition, and was evaluated in the same manner as in Example 1.

TABLE 2

| | $E_1$ (mJ/mm$^2$) | $E_2$ (mJ/mm$^2$) |
|---|---|---|
| Example 1 | 51 | 110 |
| Example 6 | 50 | 110 |
| Example 7 | 51 | 109 |
| Example 8 | 51 | 110 |
| Example 9 | 51 | 110 |
| Example 10 | 50 | 111 |
| Comparative Example 2 | 51 | 110 |

TABLE 3

| | | Torque (kg · cm) | | | Density unevenness | |
|---|---|---|---|---|---|---|
| | Polymer | Start of coloring | OD 3.0 | Difference | A | B |
| Example 1 | Styrene-maleic acid $NH_4$ (copolymerization ratio: 5/5) | 4.6 | 3.4 | 1.2 | ○ | ○ |
| Example 6 | Styrene-acrylamide | 4.8 | 3.3 | 1.5 | Δ° | Δ° |
| Example 7 | Styrene-sulfonic acid NH4 | 4.7 | 3.3 | 1.4 | ○ | ○ |
| Example 8 | Styrene-maleic acid acrylamide | 5.1 | 3.4 | 1.7 | Δ | Δ |
| Example 9 | Styrene-maleic acid $NH_4$ (copolymerization ratio: 9/1) | 5.3 | 3.4 | 1.9 | Δ | Δ |
| Example 10 | Styrene-maleic acid $NH_4$ (copolymerization ratio: 4/6) | 4.6 | 3.3 | 1.3 | ○ | ○ |
| Comparative Example 2 | none | 6.6 | 3.5 | 3.1 | x | x |

The density unevenness was evaluated to the following grades.

O: Substantially no variation was observed.

$\Delta^{O}$: Slight variation was observed.

Δ: Variation was observed, but no practical problem occurred.

x: Clear variation was observed.

It is understood from the results shown in Table 3 that when the difference in energy between the start of coloring and ODv 3.0 is 2 Kg·cm or less, density unevenness is not conspicuous. Therefore, it is understood that when the water-soluble polymer represented by the structural formula (1) is contained in the protective layer, the transporting torque of low energy at the start of coloring is decreased, lowering the difference in torque from ODv 3.0.

As described in the foregoing, it is understood that the present invention provides a heat-sensitive recording material that exhibits low sticking and printing noise and has excellent head-matching property. Furthermore, it is understood that, according to the present invention, good head-matching property is exhibited even with a thermal head having an uppermost layer having a carbon content of 90% or more excellent in wearing resistance, realizing a recording process that enables stable image recording for a long period of time. Moreover, it is understood that the present invention provides a heat-sensitive recording material of high image quality that is unlikely to exhibit density unevenness even when the applied heat energy in the scanning direction of the thermal head is quickly changed within the image.

What is claimed is:

1. A heat-sensitive recording process comprising the steps of:

(a) preparing a heat-sensitive recording material comprising a support and a plurality of layers formed on the support, said plurality of layers including at least a heat-sensitive recording layer and a protective layer formed on said heat-sensitive recording layer, said protective layer comprising at least one compound represented by one of the following structural formulae (1), (2) and (3) or a water-soluble polymer having a repeating unit represented by the following structural formula (4):

Structural formula (1)

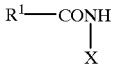

Structural formula (2)

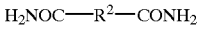

Structural formula (3)

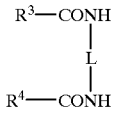

Structural formula (4)

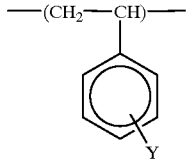

in which, in the structural formulae (1), (2) and (3), X represents H or $CH_2OH$; $R^1$, $R^2$, $R^3$ and $R^4$ each represents a saturated or unsaturated alkyl group having from 8 to 24 carbon atoms, which alkyl group is optionally branched and optionally has a hydroxyl group; $R^3$ and $R^4$ may be the same and may be different; and L represents the following structural formula (5)

Structural formula (5)

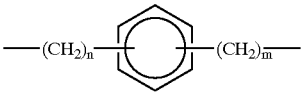

in which n+m is an integer from 0 to 8, and, in the structural formula (4), Y represents H, $—SO_3A$ or —COOA, and A represents Na, K, $NH_4$ or $NH(C_2H_4OH)_3$; and (b) subjecting said heat-sensitive recording material to heat using a thermal head which has an uppermost layer having a carbon content of at least 90%.

2. A heat-sensitive recording process as claimed in claim 1, wherein said at least one compound represented by one of the structural formulae (1), (2) and (3) is contained in said protective layer in an amount of from 0.5 to 10% by weight based on a total dry coating amount of said protective layer.

3. A heat-sensitive recording process as claimed in claim 1, wherein said at least one compound represented by one of the structural formulae (1), (2) and (3) is selected from the group consisting of stearic amide, ethylene bisstearoamide, methylol stearoamide, lauric amide, ethylene bislaurilamide, myristic amide, palmitic amide and behenic amide.

4. A heat-sensitive recording process as claimed in claim 1, wherein said protective layer contains stearic amide in an amount of from 0.5 to 10% by weight based on a total dry coating amount of said protective layer.

5. A heat-sensitive recording process as claimed in claim 1, wherein said support and said heat-sensitive recording layer are substantially transparent.

6. A heat-sensitive recording process as claimed in claim 1, wherein a thermal head is placed in contact with said heat-sensitive recording material during image recording, and a difference in transportation torque when applying a minimum amount of energy for causing coloring in said heat-sensitive recording material and when applying an amount of energy for causing an optical transmission density of approximately 3.0 is no more than 2 Kg·cm.

7. A heat-sensitive recording process as claimed in claim 1, wherein said protective layer comprises said water-soluble polymer having a repeating unit represented by the structural formula (4).

8. A heat-sensitive recording process as claimed in claim 7, wherein said water-soluble polymer comprises at least a water-soluble polymer represented by one of the following structural formulae (6), (7), (8) and (9):

Structural formula (6)

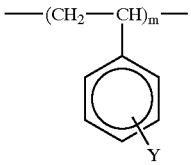

-continued

Structural formula (7)

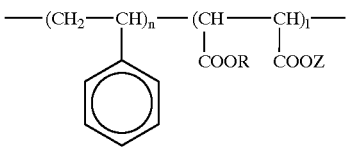

Structural formula (8)

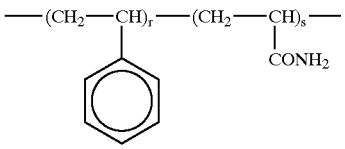

Structural formula (9)

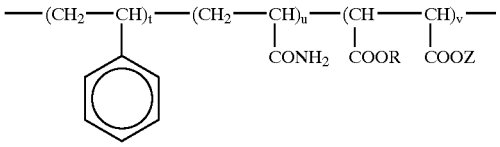

in which Y represents —$SO_3A$ or —COOA, and A represents Na, K, $NH_4$ or $NH(C_2H_4OH)_3$; m represents an integer of at least 10; n represents a number from 0.1 to 0.9, l represents a number from 0.9 to 0.1, and n+l is 1.0; r represents a number from 0.1 to 0.9, s represents a number from 0.9 to 0.1, and r+s is 1.0; t represents a number from 0.1 to 0.9, u represents a number from 0.1 to 0.9, v represents a number from 0.1 to 0.9, and t+u+v is 1.0; R represents an alkyl group having 2 or more carbon atoms; and Z represents Na, K, $NH_4$ or $NH(C_2H_4OH)_3$.

9. A heat-sensitive recording process as claimed in claim 1, wherein said protective layer contains said water-soluble polymer in an amount of from 1 to 10% by weight based on a total dry coating amount of said protective layer.

* * * * *